US006331372B1

(12) United States Patent
Livengood et al.

(10) Patent No.: US 6,331,372 B1
(45) Date of Patent: Dec. 18, 2001

(54) TONER PARTICULATES COMPRISING AN ETHYLENE PROPYLENE WAX

(75) Inventors: Bryan Patrick Livengood, Longmont; James Craig Minor, Niwot; Michael Thomas Moore, Longmont; John Melvin Olson, Boulder; Minerva Piffarerio, Erie; Vincent Wen-Hwa Ting, Boulder, all of CO (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/416,508

(22) Filed: Oct. 8, 1999

(51) Int. Cl.[7] ..... G03G 9/087; G03G 9/097

(52) U.S. Cl. ..... 430/108.8; 430/109.3; 430/137.18

(58) Field of Search ..... 430/110, 111, 430/137, 109, 108.8, 109.3, 137.18

(56) References Cited

U.S. PATENT DOCUMENTS

| | | | |
|---|---|---|---|
| 4,810,610 | 3/1989 | Grushkin et al. | 430/106.6 |
| 4,877,707 | 10/1989 | Grushkin et al. | 430/106.6 |
| 5,051,331 | 9/1991 | Sakashita | 430/110 |
| 5,338,638 * | 8/1994 | Tsuchiya et al. | 430/106 |
| 5,364,722 | 11/1994 | Tanikawa et al. | 430/110 |
| 5,389,484 | 2/1995 | Hagiwara et al. | 430/109 |
| 5,466,555 | 11/1995 | Taguchi et al. | 430/110 |
| 5,538,828 | 7/1996 | Suzuki et al. | 430/110 |
| 5,565,294 | 10/1996 | Sawai et al. | 430/110 |
| 5,658,999 | 8/1997 | Inoue et al. | 526/351 |
| 5,707,772 | 1/1998 | Akimoto et al. | 430/110 |
| 5,811,214 | 9/1998 | Osterhoudt et al. | 430/106.6 |
| 5,908,727 | 6/1999 | Kawaji et al. | 430/110 |
| 5,928,825 | 7/1999 | Eguchi et al. | 430/110 |
| 5,948,584 | 9/1999 | Hashimoto et al. | 430/110 |
| 5,952,138 | 9/1999 | Kuwashima et al. | 430/39 |
| 5,955,233 | 9/1999 | Urashima et al. | 430/109 |

* cited by examiner

*Primary Examiner*—Roland Martin
(74) *Attorney, Agent, or Firm*—John A. Brady

(57) ABSTRACT

Toner particulates include a first resin comprising a cross-linked copolymer; a second resin comprising a non-cross-linked copolymer; and a wax comprising an ethylene propylene copolymer. The cross-linked copolymer is a copolymer other than the wax comprising an ethylene propylene copolymer and the non-cross-linked polymer is a copolymer other than the wax comprising an ethylene propylene copolymer.

36 Claims, No Drawings

TONER PARTICULATES COMPRISING AN ETHYLENE PROPYLENE WAX

FIELD OF INVENTION

This invention relates to toner particulates and toner compositions comprising particulates. More particularly, the invention relates to toner particulates comprising an ethylene propylene wax.

BACKGROUND OF THE INVENTION

Numerous methods and apparatus for electrophotography, electrostatic recording and electrostatic printing are known in the art. Typically, a charged photosensitive surface, for example a charged photosensitive drum, is irradiated with an optical image and an electrostatic latent image is formed on the photosensitive surface. In the development process, a developing agent, i.e., toner, is adhered to the electrostatic latent image.

Typically, toner is fed to a developer roller by a metering blade positioned against the surface of the developing roller. The developer roller, with the toner on its surface, is typically rotated in a direction opposite to that of the photosensitive drum, and toner adheres to the electrostatic latent image to develop the image. Various toner compositions have been developed in order to provide improved copying, recording and/or printing with such apparatus.

Some printers include what is commonly referred to as an "accumulator roller," an unheated aluminum idler running against a back-up roller. The accumulator roller idles against the backup roller, and the function of the accumulator roller is to remove toner from the backup roller thereby preventing paper jams. Toner transferring from the fuser roller to the back-up roller transfers and sticks to the cooler, higher surface energy accumulator roller rather than immediately transferring back to the prints. However, as toner builds up on the accumulator roller, large pieces of toner may occasionally transfer back to the back-up roller and then to the prints, causing print quality to become objectionable. Further, continual buildup of toner on the accumulator roller may eventually cause the fuser to fail mechanically.

Grushkin et al., U.S. Pat. No. 4,810,610, disclose cold pressure fixable toner compositions comprising a blend of resin particles and magnetite particles. Grushkin et al. teach that the toner compositions may contain carbon black. Grushkin et al. further teach that resin particles include suitable thermoplastics such as polyolefins, polyamides, copolymers of ethylene and vinyl acetate and mixtures thereof, and that polyolefins include polyethylene, polypropylene or copolymers of ethylene and propylene.

Grushkin et al., U.S. Pat. No. 4,877,707 disclose a pressure fixable toner composition comprised of resin particles selected from the group consisting of ethylene/propylene copolymers, ethylene-co-vinyl acetate polymers, polyamides, and mixtures thereof, magnetite, and a release fluid. Grushkin et al. further teach the toner contains conductive particles on the surface.

Sakashita, U.S. Pat. No. 5,051,331, discloses a toner comprising a binding resin, a low-molecular weight olefin copolymer. Sakashita teaches the low-molecular weight olefin copolymer has at least two olefin monomer repeating units and has two or more peaks of melting at temperatures at between 90° C. and 170° C.

Tanikawa et al., U.S. Pat. No. 5,364,722, disclose a toner comprising a binder resin and a hydrocarbon wax, and heat-fixing methods using the toner. Tanikawa et al. teach that the binder resin may be composed of homopolymers of styrene and derivatives thereof, and styrene copolymers, such as styrene-acrylate copolymer. Tanikawa et al. further teach the hydrocarbon wax provides a differential scanner calorimeter curve showing an onset temperature of heat of absorption in the range of 50° to 110° C., and at least one heat absorption peak in the range of 70°–130° C.

Hagiwara et al., U.S. Pat. No. 5,389,484, disclose a toner having a binding resin having an acid component with an acid value of from 0.5 mg KOH/g to 100 mg KOH/g, a colorant, and defined aromatic amines. Hagiwara et al. teach that the acid component of the resin interacts with the amino group of the aromatic compounds to form an amide bond, thereby cross-linking the polymer chains. Hagiwara et al. further teach that this can impart a rubber elasticity to the toner, so that its anti-offset properties can be improved.

Suzuki et al., U.S. Pat. No. 5,538,828, disclose a toner resin composition comprising a binder primarily composed of vinyl copolymer and an ethylene copolymer. Suzuki et al. further teach the ethylene copolymer is prepared by copolymerizing ethylene and at least one alpha- or beta-derivative of acrylic acid or an unsaturated dicarbonic acid derivative. Suzuki et al. further teach toner-separating agents such as a low molecular weight polyester or polypropylene wax may be added.

Taguchi et al., U.S. Pat. No. 5,466,555, disclose a releasing composition for a toner comprising a low molecular weight polypropylene and at least one modified polyolefin. Taguchi et al. teach that suitable polypropylenes include polypropylene homopolymers, and copolymers of polypropylene with one or more other monomers copolymerizable therewith, for example, ethylenes and olefins. The releasing composition may be used in toners which comprise the releasing agent, colorant, and binder resin. Taguchi et al. teach suitable binder resins include styrenic and/or acrylic resins.

Sawai et al., U.S. Pat. No. 5,565,294, disclose a toner containing a colorant, a binding resin, and a polyethylene having a melt viscosity of 22000 to 26800 mPa·s at 140° C. Sawai et al. teach that when the melt viscosity of polyethylene is less than 2200 mPa·s at 140° C., toner components are not evenly dispersed at a kneading step in the production process of the toner.

Inoue et al., U.S. Pat. No. 5,658,999, disclose production of propylene waxes by polymerizing propylene with a solid catalyst formed of a transition metal compound or a reaction product between the transition metal compound and an organometallic compound, an aluminoxane and a fine particulate carrier. Inoue et al. further disclose a toner composition composed essentially of a binder resin, a colorant, and as a releasing agent, a propylene wax.

Akimoto et al., U.S. Pat. No. 5,707,772, disclose a toner comprised of a resin, a colorant, and a releasing agent. Akimoto et al. teach the releasing agent is a low molecular weight polyolefin polymer synthesized using a metallocene catalyst. Akimoto et al. further teach the number average molecular weight of the polyolefin is from 2,000 to 10,000, and the ratio of weight average molecular weight to number average molecular weight (Mw/Mn) is 1.6 to 3.5.

Osterhoudt et al., U.S. Pat. No. 5,811,214, disclose a developer comprising negatively charged toner particles comprising a polymeric binder, magnetic material, and a charge control agent wherein the toner particle surface contains particles of cerium dioxide, dimethyldichlorosilane treated silica, and dimethylsiloxane treated silica. Osterhoudt et al. teach the polymeric binder may comprise styrene and an alkyl acrylate and/or methacrylate. Osterhoudt et al. further teach that useful additives include release agents such as waxes, including copolymers of ethylene and propylene having a molecular weight of 1,000 to 5,000 g/mole.

Kawaji et al., U.S. Pat. No. 5,908,727, disclose a binder obtained by mixing a starting material monomer mixture of two different polymerization reactions, a compound which can react with both of the starting monomers, and a releasing agent.

Eguchi et al., U.S. Pat. No. 5,928,825, disclose a toner comprising a binder resin, a colorant, and a lubricant. Eguchi et al. teach the lubricant comprises a modified polyethylene wax obtained by grafting a monomer selected from the group consisting of styrene and unsaturated carboxylic acid onto an ethylene homo- or copolymer.

Hashimoto et al., U.S. Pat. No. 5,948,584, disclose a toner comprising toner particles containing at least a binder resin, a colorant and a wax. Hashimoto et al. teach that the binder resin comprises a hybrid component comprising a vinyl polymer component and a unit of polyester component bonded to each other.

Kuwashima et al., U.S. Pat. No. 5,952,138, disclose a magnetic developer comprising a magnetic toner containing at least a binder resin, a magnetic material, and a hydrocarbon wax which is synthesized by reaction of carbon monoxide with hydrogen or by polymerizing ethylene and which has a number average molecular weight of from 600 to 1,000. Kuwashima et al. teach the wax should have an acid value of less than 2.0 mg KOH/g, and that if the acid value is higher than 2.0 mg KOH/g, the wax's interfacial adhesion to the binder resin may become so large that smearing of characters results.

Urashima, et al., U.S. Pat. No. 5,955,233, disclose a toner comprising a polymer obtained by suspension polymerization in an aqueous medium of a polymerizable monomer composition, a coloring agent, and optionally, a magnetic powder in the presence of an epoxy resin and a crystalline (meth)acrylic ester type polymer. Urashima et al. further teach an offset-preventing agent may be incorporated, and that suitable offset-preventing agents include polyolefin wax which has a weight average molecular weight in the approximate range of 1,000 to 45,000, preferably 2,000 to 6,000, such as homopolymers of polyethylene, polypropylene and polybutylene, or olefin copolymers such as ethylene-propylene copolymer.

Unfortunately, many prior art toner compositions accumulate excessively on the accumulator roller and may be shed from the roller, thereby decreasing print quality and/or causing mechanical failure of the printer. Accordingly, a need exists to develop toners which will not accumulate excessively on the accumulator roller and which maintains good print quality.

SUMMARY OF THE INVENTION

Accordingly, it is the object of this invention to provide improved toner particulates and toner compositions.

It is another object of this invention to provide toner compositions which will not excessively accumulate on the accumulator roller.

It is also an object of this invention to provide for toner compositions which undergo eventual cross-linking after transfer to the accumulator roller, and thus pass back to the back-up roller at a limited rate due to the cross-linking, thereby preserving print quality.

It is yet another object of this invention to provide methods of decreasing the accumulation of toner on an unheated roller.

In accordance with one aspect of the present invention, there is provided toner particulates comprising a first resin comprising a cross-linked copolymer; a second resin comprising a non-cross-linked copolymer; and a wax comprising an ethylene propylene copolymer. The cross-linked copolymer is a copolymer other than the wax comprising an ethylene propylene copolymer and the non-cross-linked polymer is a copolymer other than the wax comprising an ethylene propylene copolymer.

In accordance with another aspect of the present invention, there is provided methods making a toner particulate comprising the steps of combining a first resin comprising a cross-linked polymer, a second resin comprising a non-cross-linked polymer and a wax comprising an ethylene propylene copolymer to obtain a mixture; and milling the mixture to obtain toner particles. The cross-linked polymer is not an ethylene propylene copolymer, and non-cross-linked polymer is not an ethylene propylene copolymer.

In accordance with another aspect of the present invention, there is provided methods of decreasing the accumulation of toner on an unheated roller, such as a fuser accumulator roller, of a printer, comprising the step of providing a toner composition comprising toner particulates, wherein the toner particulates comprising a first resin comprising a cross-linked polymer, a second resin comprising a non-cross-linked polymer and a wax comprising an ethylene propylene copolymer.

In accordance with another aspect of the present invention, there is provided methods of decreasing the accumulation of toner on an unheated roller, such as a fuser accumulator roller, of a printer, comprising the step of providing a toner composition comprising toner particulates, wherein the toner particulates comprise a first resin, a second resin and a wax comprising an ethylene propylene copolymer. The first resin comprises an acid functionality and has an acid value in the range of from about 5 to about 15. The second resin is substantially free of an acid functionality.

In accordance with another aspect of the present invention, there is provided toner compositions comprising a toner particulate, wherein the toner particulate comprises a first resin comprising a cross-linked polymer; a second resin comprising a non-cross-linked polymer; and a wax comprising an ethylene propylene copolymer.

In accordance with another aspect of the present invention, there is provided toner particulates comprising a first resin comprising an acid functionality, a second resin which is substantially free of an acid functionality, and a wax comprising an ethylene propylene copolymer.

Additional embodiments and advantages of the toner compositions, toner particulates, and methods herein will be apparent from the following description.

DETAILED DESCRIPTION

It is desirable that toners undergo some degree of thermosetting on the accumulator roller, for without some degree of thermosetting the toner may be easily shed from the roller and onto prints, resulting in poor print quality. However, it is at the same time desirable that the toner not accumulate excessively on the accumulator roller, for excessive accumulation can result in mechanical failure of the fuser. The inventors have found that toner particulates comprising a ethylene propylene wax provide very good print quality without accumulating on the roller to a degree which is likely to cause mechanical failure.

Toner particulates in accordance with the invention comprise resin, a wax comprising an ethylene propylene copolymer, and optionally ingredients such magnetic components, colorants and charge control agents. While not being bound by theory, it is believed the toner compositions undergo cross-linking after transfer to the accumulator roller, and thus pass back to the back-up roller at a limited rate.

Resins typically serve as binder agents. Examples of suitable resins include, but are not limited to, acrylic resins, styrene resins, polyester resins, epoxy resins, phenolic resins, polyamide resins, ethylene polymers, copolymers of these polymer resins, and the like. Preferably, the resin comprises an acrylic resin, a styrene resin or a mixture thereof. Suitable styrene resins include homopolymers of styrene and its derivatives, including alkyl, halo and/or aryl-substituted styrenes, for example poly-p-chlorostyrene, polyvinyltoluene, and polymethylstyrene, and copolymers of styrene and one or more additional monomers. Examples of comonomers for use in such styrene copolymers include vinyl monomers such as monocarboxylic acids having a double bond and substituted derivatives thereof, such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide; dicarboxylic acids having a double bond and substituted derivatives thereof, such as maleic acid, butyl maleate, methyl maleate, and dimethyl maleate; vinyl esters, such as vinyl chloride, vinyl acetate, and vinyl benzoate; ethylenic olefins, such as ethylene, propylene, and butylene; vinyl ketones, such as vinyl methyl ketone, and vinyl hexyl ketone; and vinyl ethers, such as vinyl methyl ether, vinyl ethyl ether, and vinyl isobutyl ether, used singly or in combinations of two or more with a styrene monomer. Suitable acrylic resins include acrylic and acrylate homopolymers, methacrylic and methacrylate homopolymers, acrylic and acrylate copolymers and methacrylic and methacrylate copolymers.

Preferred resins are styrene acrylic copolymers. As used herein, "styrene acrylic copolymers" refer to copolymers formed from styrene monomers and acrylic monomers. Suitable acrylic monomers include acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide; while suitable styrene monomers include styrene, alpha-methyl styrene, parachlorosytrene, vinyl toluene and divinyl benzene.

Resins typically exhibit a softening temperature and a flow temperature. As used herein, "softening temperature" is intended to refer to the temperature at which particle collapse begins, and "flow temperature" is intended to refer to the temperature at which the resin achieves sufficient liquidity to be extruded in a capillary rheometer. The softening temperature and flow temperature can be determined using rheometers such as the SHIMADZU® capillary rheometer.

The resins for use in the toner particulate may include a cross-linking agent in an amount of from about 0.01 to about 5 parts by weight per 100 parts by weight of the monomers employed therein. Conventional cross-linking agents may be used. In one embodiment, the toner comprises a resin which is free of cross-linking agents.

Toner particulates may comprise more than one resin. Generally, the resins will have a glass transition temperature of no less than 55° C. In one embodiment the particulate comprises a first resin and a second resin, each resin having a glass transition temperature of no less than about 55° C., preferably no less than about 60° C. Generally the resins will have molecular weight greater than about 2,000.

The toner particulate may comprise a first resin comprising a cross-linked polymer, and a second resin comprising a non-cross-linked polymer. In one embodiment the toner particulate comprises a resin comprising a cross-linked styrene acrylic polymer, and a resin comprising a non-cross-linked styrene acrylic polymer.

The toner particulate may comprise a first resin comprising an acid functionality, and a second resin which is substantially free of an acid functionality. The acid value, also referred to as "acid number", is measured as the numbers of milligrams of potassium hydroxide needed to neutralize one gram of resin (mg KOH/g resin). Thus, a resin having an acid value of 5 requires 5 mg of KOH to neutralize 1 g of resin. As used herein, "substantially free of acid functionality" is intended to refer to a resin having an acid value of no more than about 2, preferably no more than about 1.5. The resin having an acid functionality generally has an acid value in the range of from about 5 to about 15, preferably in the range of from about 5 to about 10, more preferably in the range of from about 6 to about 7.

The weight ratio of the first resin to the second resin is generally in the range of from about 1:0.3 to about 1:3, preferably in the range of from about 0.7:0.3 to about 0.3:0.7, more preferably about 1:1. The total amount of resin is included in the toner particulate in an amount sufficient to provide binding ability and generally is included in amount of from about 40% to about 80%, more preferably from about 50% to about 70%, by weight of the toner particulate. In one embodiment the toner particulate comprises, by weight, from about 10% to about 40%, preferably about 20% to 30%, more preferably about 26% of the first resin and from about 10% to about 40%, preferably about 20% to 30%, more preferably about 26% of the second resin.

In one embodiment the non-cross-linked polymer has a weight average molecular weight of about 275,000 and a number average molecular weight of about 8,400. The non-cross-linked polymer may have a polymodal molecular weight distribution. In one embodiment a non-cross linked polymodal styrene butyl acrylate copolymer with acid functionality has a portion with a weight average molecular weight of about 13,000, and another portion with a molecular weight of 550,000. Generally, the glass transition midpoint of the non-cross-linked copolymer is in the range of from about 55° C. to about 65° C., preferably in the range of from about 60° C. to about 65° C., more preferably about 61° C. In one embodiment, the non-cross-linked polymer, has an acid functionality and acid value in the range of from about 5 to about 15, preferably in the range of from about to about 10, more preferably in the range of from about 6 to about 7, even more preferably about 7.

A preferred non-cross-linked styrene acrylic polymer is a non-cross-linked styrene butyl acrylate copolymer having an acid functionality. Generally the log complex viscosity as measured at 120° C. and 50 radians/second of the resin (log $\eta$ at 120° C.) is in the range of from about 2 to about 5, preferably in the range of from about 3 to about 5, more preferably about 3.5; and the tangent $\delta$ of the resin at 180° C. and 50 radians/second (tan $\delta$ at 180° C.) is in the range of from about 0.5 to about 2, preferably in the range of from about 0.8 to about 1.5, more preferably about 1. Generally the softening temperature is in the range of from about 120° C. to about 140° C., preferably in the range of from about 125° C. to about 135° C., more preferably about 129° C., and the flow temperature is in the range of from about 130° C. to about 150° C., preferably in the range of from about 135° C. to about 145° C., preferably about 141° C. The weight average molecular weight (Mw) is in the range of from about 150,000 to about 500,000, preferably about 275,000, while the number average molecular weight (Mn) is in the range of from about 5,000 to about 10,000, preferably about 8,400, and the molecular weight distribution, also referred to as polydispersity (Mw/Mn) is in the range of from about 20 to about 50, preferably about 33. The glass transition midpoint (Tg) is in the range of from about 55° C. to about 65° C., preferably in the range of from about 60° C. to about 65° C., more preferably about 61° C. The acid value of the resin is in the range of from about 5 to about 15, preferably from about 5 to about 10, more preferably about 7. The resin may contain some small amount of polypropylene wax, generally no more than about 2%, preferably about 1.6%, by weight of the resin. Generally the amount of resin which is insoluble in toluene (% gel) is no more than about 6%, preferably no more than about 3%, more preferably about 0%, by weight of the resin. A suitable non-cross-linked resin having an acid functionality is commercially available as Hercules Sanyo PICCOTONER® 2200.

A preferred cross-linked polymer is a styrene butyl acrylate copolymer. In one embodiment, the cross-linked polymer is a styrene acrylic polymer, preferably a styrene butyl acrylate copolymer, which is substantially free of acid functionality. Generally, the gel content of the cross-linked styrene butyl acrylate is in the range of from about 20% to about 50%, preferably about 30% to about 50%. In one embodiment the gel content of the cross-linked styrene butyl acrylate is about 30%, while in another embodiment it is about 42%.

In one embodiment the cross-linked polymer has weight average molecular weight of about 83,000, and a number average molecular weight of about 15,000. In one embodiment the cross-linked styrene butyl acrylate copolymer is monomodal. Generally, the glass transition midpoint of the cross-linked copolymer is in the range of from about 60° C. to about 70° C., preferably in the range of from about 60° C. to about 68° C., more preferably about 64° C.

A preferred cross-linked styrene acrylic polymer is a cross-linked styrene butyl acrylate copolymer, more preferably a cross-linked styrene butyl acrylate copolymer substantially free of an acid functionality. Generally the log complex viscosity as measured at 120° C. and 50 radians/second of the resin (log δ at 120° C.) is in the range of from about 2 to about 6, preferably in the range of from about 3 to about 5, more preferably about 4.3; and the tangent δ of the resin at 180° C. and 50 radians/second (tan δ at 180° C.) is in the range of from about 0.5 to about 2, preferably in the range of from about 0.75 to about 1.25, more preferably about 1.13. Generally the softening temperature is in the range of from about 140° C. to about 160° C., preferably about 150° C., and the flow temperature is in the range of from about 150° C. to about 170° C., preferably about 162° C. The weight average molecular weight (Mw) is in the range of from about 25,000 to about 100,000, preferably in the range of from about 50,000 to 100,000, more preferably about 83,000, while the number average molecular weight (Mn) is in the range of from about 5,000 to about 20,000, preferably in the range of from about 10,000 to about 20,000, preferably about 15,000, and the molecular weight distribution, also referred to as polydispersity (Mw/Mn) is in the range of from about 4 to about 10, preferably about 6. The glass transition midpoint (Tg) is in the range of from about 60° to about 70°, preferably in the range of from about 60° to about 68°, more preferably about 64° C. The acid value of the resin is generally no more than about 5, preferably in the range of from about 0 to about 5, more preferably in the range of from about 0 to about 2. In one embodiment the acid value of the resin is no more than about 1.2, preferably 0. The resin may contain some small amount of polypropylene wax, generally no more than about 3% by weight of the resin, preferably no more than about 1% by weight of the resin, more preferably the resin is free of wax. Generally the amount of resin which is insoluble in toluene (% gel) is in the range of from about 20% to about 50%, preferably from about 30% to about 50%. In one embodiment the % gel is about 30%, while in another embodiment the % gel is about 42%. A suitable cross-linked styrene butyl acrylate substantially free of acid functionality is commercially available under the name of DIANAL® FB 206.

In one embodiment the toner particulate comprises a resin comprising non-cross-linked polymer with an acid functionality, preferably a styrene butyl acrylate copolymer with an acid functionality, and a resin comprising a cross-linked polymer, preferably a styrene butyl acrylate copolymer substantially free of acid functionality, in a weight ratio in the range of from about 45:55 to about 60:40. The acid value of the resin comprising the non-cross-linked polymer is preferably in the range of from about 5 to about 15, preferably in the range of from about 5 to about 10, more preferably in the range of from about 6 to about 7.

The toner particulate further includes a wax comprising an ethylene propylene copolymer, sometimes referred to herein as an "ethylene propylene copolymer wax". The wax generally comprises ethylene monomer and propylene monomer in a weight ratio of ethylene:propylene in the range of from about 94:6 to about 99;1, preferably about 97:3. Generally the toner particulate comprises, by weight, up to about 5%, preferably up to about 3%, of the ethylene propylene copolymer wax. In one embodiment the toner particulate comprises, by weight, from about 1% to about 3%, preferably from about 1% to 2%, more preferably from about 1.7% to 1.9%, of the ethylene propylene copolymer wax. In another embodiment the toner particulate comprises, by weight, from about 1% to about 5%, preferably from about 1% to 3%, more preferably from about 1.5% to 2%, of the ethylene propylene copolymer wax.

Although the toner particulate may optionally comprise other waxes, in one embodiment the toner is substantially free of, preferably free of, waxes other than the ethylene propylene copolymer wax. As used herein, "substantially free of waxes other than the ethylene propylene copolymer wax" is intended to mean that the only additional wax present in the toner is the small amounts of wax present in the resins. Generally no more than about 2%, preferably no more than 0.4%, by weight of the toner particulate, is a wax other than the ethylene propylene copolymer wax.

Generally the toner particulate is substantially free of, preferably free of, polypropylene wax. As used herein, "substantially free of propylene wax" is intended to mean that the only polypropylene wax present in the toner is the small amounts of polypropylene wax present in the resins. Generally the toner particulate comprises no more than about 2%, preferably no more than 0.4%, by weight of the toner particulate, polypropylene wax.

Generally the ethylene propylene copolymer wax has a molecular weight in the range of from about 500 to about 1000, preferably in the range of from about 500 to about 750. In one embodiment the ethylene propylene copolymer wax has a molecular weight of about 650. The melting point of the wax is generally less than about 120° C., preferably less than about 100° C., more preferably about 96° C. The melt viscosity of the wax is generally in the range from about 8 to about 16, preferably about 12, centipoise at 99° C. In one embodiment the toner comprises an ethylene propylene copolymer wax which has not been modified with carboxylic acids or anhydrides. A suitable commercially available wax is PETROLITE® EP-700 from Baker Petrolite.

The toner particulate may further comprise a magnetic component. Suitable magnetic components include magnetic pigments, metal oxides or mixture thereof known in the art and typically employed in toner particulates. In one embodiment the toner particulate comprises iron oxide. Suitable iron oxides include magnetite, hematite, ferrite, and modified forms of such oxides, one preferred iron oxide is magnetite. The toner particulate comprises, by weight, from about 20% to about 60%, preferably from about 44% to about 50%, more preferably about 46%, magnetic component.

The toner particulate may further include one or more charge control agents which contribute to stabilize the charge characteristics of the toner composition. In accordance with the present invention, the toner composition preferably is a negatively charged toner. Negative-charge control agents include, but are not limited to, organic metal complexes or chelates such as a chromium, zinc, iron or aluminum complex of an organic compound. Complexes or chelates of organic acids, azo compounds and the like are also suitable. Further examples of the charge control agent include quaternary ammonium salts, various electron attractive/donative inorganic powders, inorganic materials surface treated with a polar material, polar polymer beads and the like, in one embodiment the toner particulate comprises an azo charge control agent, preferably a chromium charge control agent.

The charge control agent is included in the toner particulate in an amount sufficient to stabilize the charge characteristics. In one embodiment the toner particulate comprises, by weight, from about 0.1% to about 10%, preferably from about 0.25% to about 5%, more preferably from about 0.5% to 2%, and even more preferably about 0.75% of a charge control compound.

In one embodiment the toner particulate further comprises a colorant. Suitable colorants include dyes and pigments. Any commonly employed pigment or dye may be used. Pigments which are suitable colorants includes azo pigments such as condensed and chelate azo pigments; polycyclic pigments such as phthalocyanines, anthraquinone, quinacridones, thioindigoids, isoindolinones, and quinophthalones; nitro pigments, daylight fluorescent pigments; carbonates; chromates, titanium oxides. zinc oxides; iron oxides and carbon black. In one embodiment the toner particulate comprises pigment, preferably carbon black. The pigments may be prepared via conventional techniques.

The toner particulates of the present invention are prepared in accordance with methods generally known in the toner art. For example, the resins and a wax comprising an ethylene propylene copolymer may be kneaded with one another, pulverized and typically classified to provide toner particles of a desired size. Kneading may be performed with a heat-kneading machine such as a heat roller, a kneader, or an extruder. Milling or pulverizing may be performed with any suitable crushing or grinding mill.

Typically toner particulates have a diameter in the range of from about 1 to about 50 $\mu$m, and more preferably in the range of from about 1 to about 25 $\mu$m, and even more preferably from about 6 to about 12 $\mu$m. A preferred particle size distribution is one wherein the median particle diameter size is in the range of from about 6 $\mu$m to about 12 $\mu$m, preferably in the range of from about 7 $\mu$m to about 9 $\mu$m.

In one embodiment, the toner particulate ingredients are mixed, sifted into an extruder and melt mixed. The mixture coming out of the extruder is solidified using an underwater pelletizer or chilled roller. The mixture is then milled in an airjet mill and classified to obtain toner particulates of the desired size.

The milled and classified toner particulates may be blended in a high-speed blender with silicas, inorganic oxides and/or polymeric microspheres. Suitable silicas include fumed silica and hydrophobically treated fumed silica, preferably the silica is a hydrophobically treated fumed silica. Suitable polymeric microspheres include styrene acrylic microspheres. In one embodiment, the resulting toner composition comprises the toner particulates with silica, inorganic oxides and/or microspheres associated on the surface thereof. In another embodiment the resulting toner composition comprises the toner particulates with silica and/or inorganic oxides associated on the surface thereof, and further comprises microspheres which may be associated on the toner particulate surface and/or may be present in the toner composition as a second particulate which is not associated on the toner particulate surface.

In one embodiment the toner particulates are blended with silica, preferably hydrophobically treated fumed silica, and styrene acrylic microspheres. The toner particulates may be blended with from about 0.8% to about 1.2%, preferably about 1% silica and from about 0.1% to 0.15%, preferably 0.13%, styrene acrylic microspheres, by weight of total toner composition.

Preferably, toner compositions comprising toner particulates in accordance with the invention are applied to substrates such as paper. In one embodiment, after application to the paper, the toner composition is heated and pressed. A fuser assembly, having at least one rotating heat roller and at least one rotating pressure roller, may be used for heating and pressing. The heat roller and pressure roller may be arranged in opposition to each other to form a nip. The paper is passed through the nip. Heat and pressure are applied as the paper passes between the rotating heat and pressure rollers. The rollers' speed of rotation may be adjusted, for example, to about 2.6 inches per second.

Generally heat is applied at a temperature range of at least about 100° C., preferably from about 100° C. to about 250° C., more preferably from about 170° C. to about 190° C. Pressure may be applied at least about 10 pounds per square inch, preferably from about 10 to about 30 pounds per square inch.

Toner particulates according to the present invention will be further illustrated in the following examples. Throughout the examples and the present specification, parts and percentages are by weight unless otherwise specified.

EXAMPLE 1

Tables 1 and 2 below set forth toner particulates in accordance with the present invention.

TABLE 1

Toner Particulate Composition

| Ingredient | Weight Percent |
|---|---|
| Non-cross-linked styrene butyl acrylate copolymer with acid functionality | 26% |
| Cross-linked styrene butyl acrylate copolymer substantially free of acid functionality | 26% |
| Iron oxide | 46% |
| Ethylene propylene wax | 1.3% |
| Charge control agent | 0.75% |

TABLE 2

Toner Particulate Composition

| Ingredient | Weight Percent |
|---|---|
| Non-cross-linked styrene butyl acrylate copolymer with acid functionality | 26% |
| Cross-linked styrene butyl acrylate copolymer with substantially free of acid functionality | 26% |
| Iron oxide | 46% |
| Ethylene propylene wax | 1.9% |
| Charge control agent | 0.75% |

The non-cross-linked copolymer is commercially available as Hercules Sanyo PICCOTONER® 2200, and the cross-linked copolymer is commercially available as DIANAL® FB 206. The ethylene propylene wax has a melting point of about 96° C. and a weight average molecular weight of about 650, and is commercially available as PETROLITE® EP-700. The charge control agent is a chromium azo complex.

EXAMPLE 2

Experimental and control toners are evaluated using otherwise standard production cartridges. A fuser is modified to facilitate the removal of the accumulator roller and allow it to be easily weighed to determine the rate of toner buildup. Print quality was determined by visual inspection and rated as fair, good, or very good. The control toners comprise prior art toner particulates comprising polypropylene wax, while the experimental toners comprise particulates in accordance with the invention, comprising ethylene propylene copolymer wax.

Control toner 1 is a commercially available toner believed to comprise about 48% of an 80:20 styrene butyl acrylate resin, about 49% iron oxide, an iron azo charge control agent, and a polypropylene wax.

Control toner 2 comprises toner particulates comprising, by weight, about 26% of a non-cross-linked styrene butyl acrylate copolymer with acid functionality, about 26% of a cross-linked styrene butyl acrylate substantially free of acid functionality, approximately 46% iron oxide, about 0.75% of a chromium azo complex charge control agent, and about 1.4% of a polypropylene homopolymer wax.

Experimental toners 1, 2, 3 and 4 each comprise toner particulates comprising, by weight, about 26% of the non-cross-linked styrene butyl acrylate copolymer with acid functionality, about 26% of the cross-linked styrene butyl acrylate resin substantially free of acid functionality, about 46% iron oxide, and about 0.75% chromium azo complex charge control agent. The particulates of experimental toners 1, 2, 3 and 4 comprise about 1.3%, 1.5%, 1.7% and 1.9% ethylene propylene copolymer wax, respectively, by weight of total particulate.

The accumulation rate and print quality data is set forth below in Table 3.

TABLE 3

Comparison of Prior Art and Inventive Toner Particulates

| Sample | Accumulator Roller Weight Gain (Grams) | Print Quality |
|---|---|---|
| Control Toner 1 | 0.21 | fair |
| Control Toner 2 | 0.18 | good |
| Experimental Toner 1 | 0.18 | very good |
| Experimental Toner 2 | 0.17 | very good |
| Experimental Toner 3 | 0.15 | very good |
| Experimental Toner 4 | 0.085 | very good |

The accumulator roller weight gain decreases significantly as the amount of ethylene propylene copolymer wax is increased. Ethylene propylene copolymer wax does not impact print quality until reaching about 1.9%, when a slight decrease in optical density on cold starts occurs. The reduction in toner build up on the accumulator roller results in improved print quality and reduction of mechanical fuser failure.

Additional embodiments and modifications within the scope of the claimed invention will be apparent to one of ordinary skill in the art. Accordingly, the scope of the present invention shall be considered in the terms of the following claims, and is understood not to be limited to the details of the methods described in the specification.

What is claimed is:

1. A toner particulate comprising:

(a) a first resin comprising a cross-linked copolymer comprising styrene monomer and acrylic monomer;

(b) a second resin comprising a non-cross-linked copolymer comprising styrene monomer and acrylic monomer; and (c) a wax comprising an ethylene propylene copolymer having a molecular weight in the range of from about 500 to about 1000.

2. A toner particulate according to claim 1, wherein the weight ratio of the first resin to the second resin is from about 0.7:0.3 to about 0.3:0.7.

3. A toner particulate according to claim 2, wherein the ratio of the first resin to the second resin is about 1:1.

4. A toner particulate according to claim 1, wherein the toner particulate comprises, by weight, from about 40% to about 80% of the first resin and second resin combined.

5. A toner particulate according to claim 1, further comprising an ingredient selected from the group consisting of magnetic components, colorants, charge control agents and mixtures thereof.

6. A toner particulate according to claim 1, wherein the wax has a melting point of less than about 100° C.

7. A toner particulate according to claim 1, wherein the second resin further comprises an acid functionality, and has an acid value in the range of from about 5 to about 15.

8. A toner particulate according to claim 1, wherein the second resin comprises a non-cross-linked copolymer comprising styrene monomer, acrylic monomer and an acid functionality, and has an acid value in the range of from about 5 to about 15;

the weight ratio of the first resin to the second resin is from about 0.7:0.3 to about 0.3:0.7; and the wax comprising an ethylene propylene copolymer is present in an amount of from about 1.7% to about 1.9% by weight of the particulate and has a melting point of less than about 100° C.

9. A method of making a toner particulate comprising the steps of:

combining a first resin comprising a cross-linked copolymer comprising styrene monomer and acrylic monomer, a second resin comprising a non-cross-linked copolymer comprising styrene monomer and acrylic monomer, and a wax comprising an ethylene propylene copolymer having a molecular weight in the range of from about 500 to about 1000 to obtain a mixture; and milling the mixture to obtain toner particles.

10. A method according to claim 9, wherein the weight ratio of the first resin to the second resin is from about 0.7:0.3 to about 0.3:0.7.

11. A method of decreasing the accumulation of toner on an unheated roller of a printer, comprising the step of providing a toner composition comprising toner particulates, wherein the toner particulates comprise a first resin comprising a cross-linked copolymer comprising styrene monomer and acrylic monomer, a second resin comprising a non-cross-linked copolymer comprising styrene monomer and acrylic monomer and a wax comprising an ethylene propylene copolymer having a molecular weight of from about 500 to about 1000.

12. A method of decreasing the accumulation of toner on an unheated roller of a printer, comprising the step of providing a toner composition comprising toner particulates, wherein the toner particulates comprise a first resin comprising a cross-linked copolymer comprising styrene monomer and acrylic monomer, a second resin comprising a non-cross-linked copolymer comprising styrene monomer and acrylic monomer and a wax comprising an ethylene propylene copolymer having a molecular weight of from about 500 to about 1000;

and further wherein the first resin is substantially free of an acid functionality and the second resin comprises an acid functionality and has an acid value in the range of from about 5 to 15.

13. A method according to claim 12, wherein the first resin comprises a cross-linked styrene butyl acrylate copolymer, and the second resin comprises a non-cross-linked styrene butyl acrylate copolymer.

14. A method according to claim 13, the wax comprising an ethylene propylene copolymer is present in an amount of from about 1.7% to about 1.9%, by weight of the particulate, and has a melting point of less than about 100° C.

15. A toner composition comprising a toner particulate, wherein the toner particulate comprises:

a first resin comprising a cross-linked copolymer comprising styrene monomer and acrylic monomer;

a second resin comprising a non-cross-linked copolymer comprising styrene monomer and acrylic monomer; and a wax comprising an ethylene propylene copolymer having a molecular weight of from about 500 to about 1000.

16. A toner particulate comprising:

(a) a first resin substantially free of an acid functionality, said first resin being a cross-linked polymer comprising styrene monomer and acrylate monomer;

(b) a second resin comprising an acid functionality, said second resin being a non-cross-linked polymer comprising styrene monomer and acrylate monomer; and (c) a wax comprising an ethylene propylene copolymer having a molecular weight of from about 500 to about 1000.

17. A toner particulate according to claim 16, wherein the second resin has an acid value in the range of from about 5 to about 15.

18. A toner particulate according to claim 17, wherein the first resin is a cross-linked styrene butyl acrylate copolymer and the second resin in a non-cross-linked styrene butyl acrylate copolymer.

19. A toner particulate according to claim 16, wherein the first resin has a molecular weight of greater than about 2000, and the second resin has a molecular weight of greater than about 2000.

20. A toner particulate comprising:

(a) a first resin comprising a cross-linked copolymer;

(b) a second resin comprising a non-cross-linked copolymer; and (c) a wax comprising an ethylene propylene copolymer in a weight ratio of ethylene:propylene in the range of from about 94:6 to about 99:1;

wherein the cross-linked copolymer is other than the wax comprising an ethylene propylene copolymer and the non-cross-linked copolymer is other than the wax comprising an ethylene propylene copolymer.

21. A toner particulate according to claim 20, comprising up to about 3%, by weight, of the wax comprising an ethylene propylene copolymer.

22. A toner particulate according to claim 21, comprising from about 1.7% to about 1.9%, by weight, of the wax comprising an ethylene propylene copolymer.

23. A method of making a toner particulate comprising the steps of:

combining a first resin comprising a cross-linked polymer, a second resin comprising a non-cross-linked polymer and a wax comprising an ethylene propylene copolymer in a weight ratio of ethylene:propylene in the range of from about 94:6 to about 99:1 to obtain a mixture; and milling the mixture to obtain toner particles;

wherein the cross-linked polymer is other than the wax comprising an ethylene propylene copolymer and the non-cross-linked polymer is other than the wax comprising an ethylene propylene copolymer.

24. A method according to claim 23, wherein the median toner particulate diameter is in the range of from about 6.85 $\mu$m to about 7.55 $\mu$m.

25. A method according to claim 24, wherein the volume percent of toner particulates having a diameter of less than 4 $\mu$m is in the range of from about 1.5% to about 3.5%, and the volume percent of toner particulates having a diameter of greater than 10 $\mu$m is in the range of from about 2% to about 11%.

26. A method according to claim 23, wherein the mixture further comprises a magnetic component.

27. A method according to claim 26, wherein the step of combining the first resin, the second resin, the wax and the magnetic component to obtain a mixture comprises melt-mixing the first resin, the second resin, the wax and the magnetic component.

28. A method of decreasing the accumulation of toner on an unheated roller of a printer, comprising the step of providing a toner composition comprising toner particulates, wherein the toner particulates comprise a first resin comprising a cross-linked polymer, a second resin comprising a non-cross-linked polymer and a wax comprising an ethylene propylene copolymer in a weight ratio of ethylene:propylene in the range of from about 94:6 to about 99:1, and wherein the cross-linked polymer is other than the wax comprising an ethylene propylene copolymer and the non-cross-linked polymer is other than the wax comprising an ethylene propylene copolymer.

29. A method according to claim 28, further comprising the steps of applying the toner composition to a substrate and applying heat and pressure to the toner composition.

30. A method according to claim 28, wherein the toner particulate further comprises an ingredient selected from the group consisting of magnetic components, charge control agents, colorants and mixtures thereof.

31. A method according to claim 28, wherein the wax has a melting point of less than about 100° C.

32. A method of decreasing the accumulation of toner on an unheated roller of a printer, comprising the step of providing a toner composition comprising toner particulates, wherein the toner particulates comprise a first resin, a second resin and a wax comprising an ethylene propylene copolymer in a weight ratio of ethylene:propylene in the range of from about 94:6 to about 99:1;

and further wherein the first resin is substantially free of an acid functionality and the second resin comprises an acid functionality and has an acid value in the range of from about 5 to about 15.

33. A toner composition comprising a toner particulate, wherein the toner particulate comprises:

a first resin comprising a cross-linked polymer other than an ethylene propylene copolymer;

a second resin comprising a non-cross-linked polymer other than an ethylene propylene copolymer; and a wax comprising an ethylene propylene copolymer in a weight ratio of ethylene:propylene in the range of from about 94:6 to about 99:1.

34. A toner composition according to claim 33, wherein the toner composition further comprises silica.

35. A toner composition according to claim 33, wherein the toner composition further comprises styrene acrylic microspheres.

36. A toner particulate comprising:

(a) a first resin substantially free of an acid functionality;

(b) a second resin comprising an acid functionality; and (c) a wax comprising an ethylene propylene copolymer in a weight ratio of ethylene:propylene in the range of from about 94:6 to about 99;1, wherein the first resin is other than the wax comprising an ethylene propylene copolymer, and the second resin is other than the wax comprising an ethylene propylene copolymer.

* * * * *